United States Patent [19]

Keezer et al.

[11] 4,076,858

[45] Feb. 28, 1978

[54] ELECTROSTATIC COPYING PROCESS WITH CHARGING OF THE ORIGINAL

[75] Inventors: Richard C. Keezer, Los Altos, Calif.; Werner E. L. Haas, Webster, N.Y.

[73] Assignee: Xerox Corporation, Stamford, Conn.

[21] Appl. No.: 513,768

[22] Filed: Oct. 10, 1974

[51] Int. Cl.[2] ..... G03G 13/04; G03G 13/08; G03G 13/22

[52] U.S. Cl. ..... 427/19; 101/DIG. 13; 427/24

[58] Field of Search ..... 427/14, 19, 24; 101/DIG. 13

[56] References Cited

U.S. PATENT DOCUMENTS

| | | | |
|---|---|---|---|
| 2,647,464 | 8/1953 | Ebert | 101/426 |
| 3,770,484 | 11/1973 | Shreeve | 427/14 X |
| 3,849,126 | 11/1974 | Cantarano | 96/1.4 X |
| 3,928,669 | 12/1975 | Takahashi | 427/19 |

OTHER PUBLICATIONS

Translation of German Patent 1,497,174, 1969.

*Primary Examiner*—Harry J. Gwinnell
*Assistant Examiner*—Stuart D. Frenkel

[57] ABSTRACT

An apparatus and method for electrostatic copying in which the original document is transported on a conductive grounded plate to several processing stations. The document is positioned with its image or front side on the surface of the plate. At a charging station, the back side of the document receives a uniform electrostatic charge which, in the image regions, leaks off through the plate to provide a latent electrostatic image. The document is then transported to a developing station for development of the latent image with toner and then to a transfer station where the toner is transferred to a final support material and fused to such material. Residual toner is then removed at a cleaning station.

6 Claims, 1 Drawing Figure

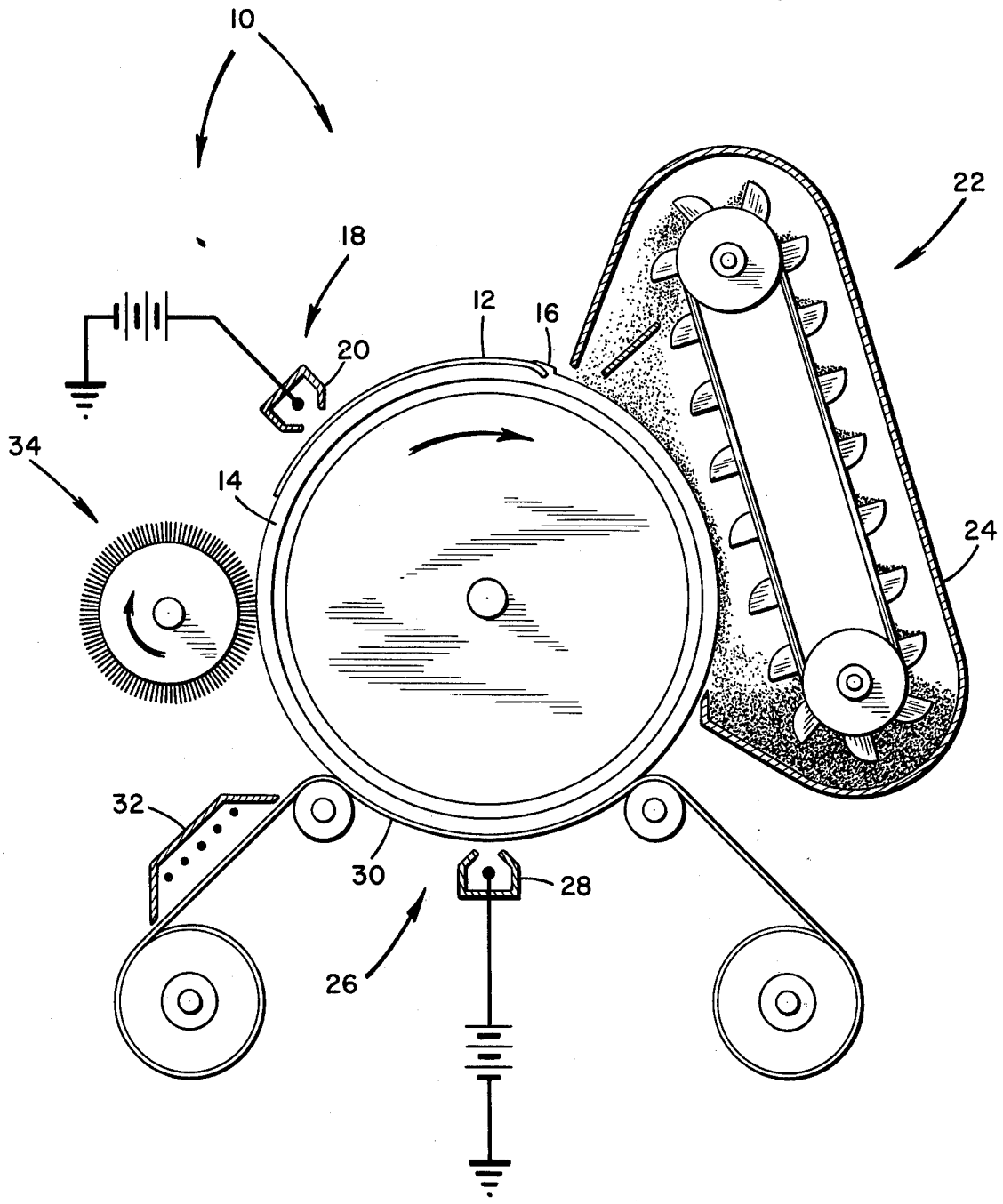
10
18
20
12
16
22
34
14
24
32
30
28
26

ELECTROSTATIC COPYING PROCESS WITH CHARGING OF THE ORIGINAL

BACKGROUND OF THE INVENTION

In prior art electrostatic copying processes, a plurality of steps are required for producing a copy of an original document. The first step includes charging a photoconductive surface with a uniform electrostatic charge. The second step comprises exposing the charged photoconductive surface with a light or radiation pattern of the original to form a latent electrostatic image of the copy to be produced. The third step consists of developing the latent electrostatic image with toner powder particles to form a toner powder image in the configuration of the desired copy. Transfer of the toner powder image to a transfer material and fixing or fusing of the transferred image are the fourth and fifth steps in the process. The final step consists of cleaning and discharging the photoconductive surface to remove residual toner particles and discharge residual electrostatic charge in preparation for making another copy.

The prior art performs these steps at various processing stations in which a wide variety of equipment is required to carry out the method. For example, at the exposure station, a light source and optics are needed to illuminate the original, focus the light reflected from the original and provide proper scanning to dissipate charges on the photoconductor, thereby providing a latent image. In addition, a photoconductive surface is needed to produce the copy.

A disadvantage with this prior art process is that with each station expensive equipment is employed, which increases the cost and size of the copying machine. Furthermore, because of the use of a photoconductive surface, the process cannot be performed under ambient lighting conditions. This means that the copying machine must be enclosed or sealed in a manner to prevent ambient light from striking the photoconductor, thereby increasing the complexity and cost of the machine.

In U.S. Pat. No. 2,647,464, an electrostatic photocopying technique is disclosed in which a photoconductor is not used to generate a copy. In this reference the original is placed image side down on a dielectric surface and an electrostatic charge is applied to the surface through the original. Next the original is stripped from the surface, the surface then being developed with toner powder. The powder image is then transferred to a final support material. A disadvantage with this technique is that the latent electrostatic image is disturbed when the original is stripped from the dielectric surface, thereby preventing a clear copy from being produced. Furthermore, a specially prepared dielectric surface made by, for example, vacuum evaporation must be used for this process.

SUMMARY OF THE INVENTION

The present invention provides novel method and apparatus for producing a copy of an original document. In particular, the present invention provides a technique for electrostatically copying in which a latent electrostatic image is formed on the back side of the original document, the image then being developed and transferred to a recording medium.

It is an object of the present invention to simplify the method and apparatus required for electrostatically producing a copy.

It is a further object of the present invention to enable an electrostatic copying method to be carried on under ambient lighting conditions.

A still further object of the present invention is to electrostatically copy a document without requiring an illumination source, optics or a photoconductor.

Another object of the present invention is to utilize the different electrical properties between marked and unmarked areas of paper to create a differential electrostatic pattern when the paper is uniformly charged, which pattern can be developed with charged particles.

It is yet another object of the present invention to provide an electrostatic copying process in which a latent electrostatic image is placed on the back side of the document to be copied having background and image areas, the image then being developed and transferred to a recording medium.

BRIEF DESCRIPTION OF THE FIGURE

The single FIGURE is a cross-sectional representation of apparatus used for carrying out the present invention.

DETAILED DESCRIPTION OF THE DRAWINGS

The single FIGURE discloses several electrostatic copying processing stations 10. An original document 12, i.e., the document to be copied, is placed image side or front side down against the peripheral surface of an electrically conductive grounded drum 14 and held there by a gripper 16. Drum 14 is rotated in the direction of the arrow to move document 12 past the several processing stations.

At charging station 18, a uniform negative electrostatic charge provided by corotron 20 is deposited on the back side of document 12. With the image side of the document 12 having inked image areas and white background areas, after charging the negative charge will dissipate or conduct through the back side portions opposite the inked areas, the inked areas and the conductive drum 14 to ground, leaving a charge only on the back side portions of the document opposite the background area. Thus a latent electrostatic image is formed on such back side.

The document 12 is then moved to the development station 22 at which a cascade developer 24 cascades developing material including toner particles over the back side of the document. The back side of the document 12 is developed with standard toner particles having the same charge as the latent electrostatic image, i.e., a negatively charged toner. The toner particles will be repelled by the negative electrostatic image corresponding to the background areas but will adhere or settle on the back side of the document 12 opposite the image areas.

The developed image is then rotated by drum 14 to the transfer station 26 where the toner particles are transferred electrostatically from the back side of document 12 to a final transfer or support material. At the transfer station 22 a corotron 28 emitting positive charges is employed to attract the negative particles and transfer them to ordinary paper 30. In the alternative, the toner particles can be transferred to a transparent plastic which, for example, may be used for slides. The transferred toner is then fixed to the paper 30 by radiant heat provided by a fuser 32 to form a copy.

At a drum cleaning station 34, the back side of document 12 is brushed to remove residual toner particles remaining thereon after transfer. It should be noted that the cleaning step is not necessarily needed as most of the toner will be transferred to the paper 30. The document 12 is then ready for another cycle of operation.

The present invention may be performed with alternative apparatus to that shown in the drawing. Thus, magnetic brush development apparatus could be used in lieu of cascade developer. Furthermore, though a drum type transport such as drum 16 has been described, the process could be carried out in a machine using a flat plate type transport.

The present process will produce adequate copies as long as the original document exhibits differential electrical properties. That is, the original document should have image and background areas that are electrically different in that such image and background areas accept different amounts of electrostatic charge or, if the charge is accepted equally, the background and image areas discharge differently. These properties may be provided with a document of ordinary paper having marks (the image area) of ink, toner, graphite, etc.

Though any material exhibiting the electrical properties noted above could be suitable for use in the present process, it has been found that an original document having a fused toner image on it will present more suitable copies. Thus the original for this process may be a document prepared by conventional electrostatic photocopying techniques employing optics, an illumination source and a photoconductor, as are used in a standard Xerox copier.

The reason why such a document having a fused toner image will present better copies is not completely understood. One factor may be that the fused toner image is a raised image with respect to the background areas and this presents better physical and electrical contact between the image and conductive drum 14, whereby the charge may leak off to ground. This type of image is to be distinguished from, for example, a typewritten document in which the image or letters are indented with respect to the background area, thereby not providing as good a physical and electrical contact.

The transport drum 14 may be made of aluminum having a natural oxide coating on the peripheral surface on which the original is placed. Furthermore, though the process has been described with negative charging and negatively charged toner, the invention also may be performed with positive charging of the document 12 and developing with negatively charged toner. In this latter case, reversal images will be produced.

Although the invention is described in detail for the purpose of illustration it is to be understood that such detail is solely for that purpose and that variations can be made therein by those skilled in the art without departing from the spirit and scope of the invention except as it may be limited by the claims.

What is claimed is:

1. A method for electrostatically copying an original document using an electrically conductive grounded plate, said document being comprised of ordinary paper having a fused toner image on a front side thereof, said paper and said image having different electrical properties comprising either the acceptance of different amounts of electrostatic charge, respectively, or if the charge is accepted equally, then discharging differently, respectively, comprising the steps of:

placing the front side of said document in contact with said conductive plate;

uniformly depositing an electrostatic charge on the backside of said document whereby portions of said charge are dissipated to form an electrostatic image thereon;

developing said electrostatic image, and transferring the developed image to a support material.

2. The method of claim 1 wherein the steps of depositing and developing are performed under ambient lighting conditions.

3. A method of claim 1, wherein said developing step comprises developing said electrostatic image with toner and wherein the polarity of the electrostatic charge deposited on said document and the charge on said toner are the same.

4. The method of claim 3 further including the steps of cleaning residual toner remaining on the opposite side of the document after transfer of the image to the final support material.

5. The method of claim 4 in which the conductive member is aluminum having a natural oxide coating on the surface which contacts the image side of the document.

6. The method of claim 5 wherein the step of transferring includes directing a charge having a polarity opposite to the charge of the toner to the other side of the support material.

* * * * *